US005427200A

United States Patent [19]

Yemini

[11] Patent Number: 5,427,200

[45] Date of Patent: Jun. 27, 1995

[54] SAWHORSE WITH ROTATABLE BASES

[75] Inventor: Zvi Yemini, Tel Aviv, Israel

[73] Assignee: Zag Ltd., Tel Aviv, Israel

[21] Appl. No.: 285,689

[22] Filed: Aug. 4, 1994

[51] Int. Cl.[6] ..... B27B 21/00

[52] U.S. Cl. ..... 182/153; 182/225

[58] Field of Search ..... 182/225–227, 182/153, 181–186; 248/180, 186

[56] References Cited

U.S. PATENT DOCUMENTS

| | | | |
|---|---|---|---|
| 906,680 | 12/1908 | Berger | 248/180 |
| 1,259,126 | 3/1918 | Parkes | 248/186 |
| 3,016,802 | 1/1962 | Grunenberg | 248/186 X |
| 3,035,660 | 5/1962 | Leon | 182/181 |
| 4,375,245 | 3/1983 | Schill | 182/155 |
| 5,184,697 | 2/1993 | Crewe | 182/225 X |

*Primary Examiner*—Alvin C. Chin-Shue
*Attorney, Agent, or Firm*—Mark M. Friedman

[57] ABSTRACT

An easily storable sawhorse which includes a cross beam and a pair of bases which are rotatable relative to the cross beam. Each of the bases includes a triangular frame and a rotatable member which is connected at its upper end to the cross beam and which has an externally threaded lower end which fits into a recess formed in the top portion of the frame. A nut mounted on the frame engages the externally threaded portion of the rotatable member and connects the rotatable member to the frame while rotation of the nut causes the rotatable member to be raised, permitting the rotation of the bases relative to the cross beam, or lowered to tightly hold the rotatable member and the frame of the base together to provide a steady working surface.

20 Claims, 4 Drawing Sheets

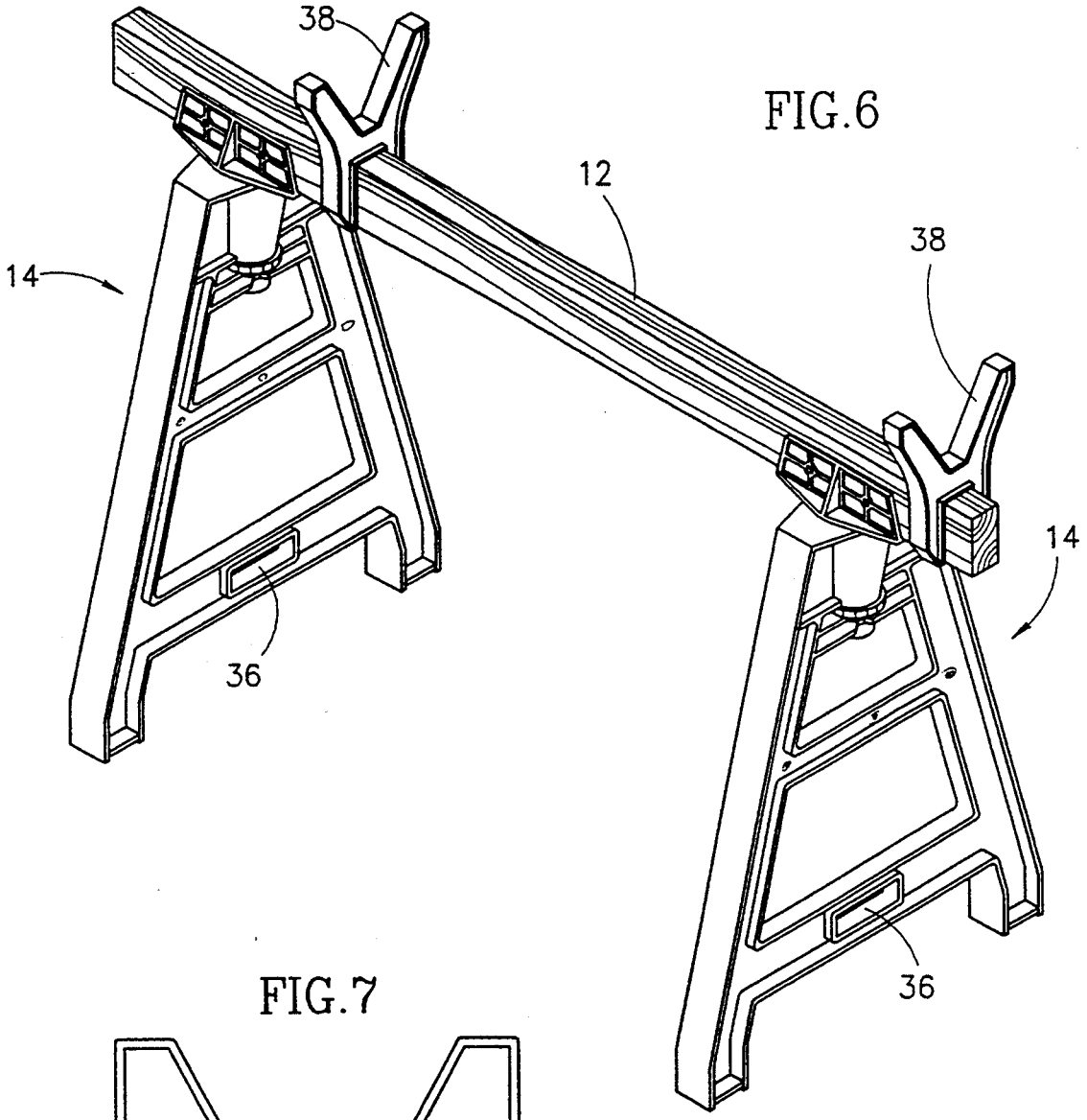
FIG.6
FIG.7
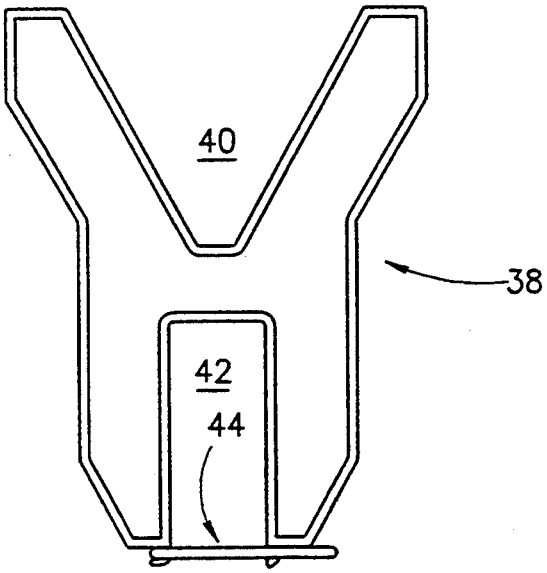
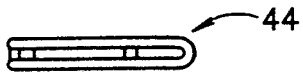
FIG.8

SAWHORSE WITH ROTATABLE BASES

FIELD AND BACKGROUND OF THE INVENTION

The present invention relates to sawhorses and, more particularly, to sawhorses having rotatable bases which make it possible to significantly reduce the effective volume occupied by the sawhorse when not in use.

Sawhorses have been in common use for many years. A pair of sawhorses provides the user, typically a carpenter or woodworker, a convenient support on which to rest the material which is to be worked.

A sawhorse is typically made up of a cross beam, typically made of wood, and a pair of substantially triangular bases. The apex of each triangular base is connected to the cross beam at one of its ends. Each base extends downward from the apex and terminates in a relatively wide base which rests on the ground and provides stable support to the cross beam on which the work piece it to be placed.

In traditional sawhorses the connection between each of the bases and the cross beam was effectively permanent so that the sawhorse had a single fixed configuration which was rather bulky and presented serious difficulties in storing of the sawhorses between uses.

Several suggestions have been offered to solving the storage problem. One class of solutions provides sawhorses which are foldable, or collapsible, so that after use the effective volume, or bulk, of the sawhorse can be reduced by taking advantage of various hinges and tracks to displace certain portions of the sawhorse relative to others so as to reduce the bulk of the sawhorse for storage. These configurations are typically complicated to produce, and therefore expensive, and are cumbersome to use.

Another class of solutions involves providing bases which are rotatable relative to the beam so that when the sawhorse is to be stored the bases can be made to rotate approximately 90° so that they lie substantially parallel to, or in a common plane with, the cross beam, thereby greatly reducing the bulk of the sawhorse.

One example of such as solution, teaching the rotation of the bases relative to the cross beam for storage, is disclosed in U.S. Pat. No. 4,508,194. However, the configuration described is very complicated and would costly to build and cumbersome to operate.

More recently, another example has been disclosed in U.S. Pat. No. 5,184,697 which describes a sawhorse with leg assemblies which are attached to the cross beam with swivel assemblies. Each swivel assembly includes a foot member connected to the cross beam which is nested in a shoe member which forms a part of the leg assemblies. The foot and shoe members have cooperating detents and recesses for locking the leg assemblies in position.

The configuration disclosed suffers from a serious disadvantage in that in order to rotate the leg assemblies relative to the cross beam it is necessary to separate, or retract, the foot member and shoe member from each other to allow the detents and recesses to disengage before the leg assemblies can be rotated relative to the cross beam. The retraction is carried out against the biasing force of a spring and requires the user to pull the cross beam and one of the leg assemblies apart against the biasing force and then, while continuing to apply force to keep the two member apart, simultaneously rotate the leg assembly relative to the cross beam. The operation is somewhat awkward and unnatural and requires a small measure of acrobatics on the part of the user.

There is thus a widely recognized need for, and it would be highly advantageous to have, a sawhorse which could be readily and easily reduced in bulk for storage and which would be inexpensive to build and convenient to operate.

SUMMARY OF THE INVENTION

According to the present invention there is provided a sawhorse base for supporting a sawhorse cross beam above the ground, comprising: (a) a substantially triangular frame having a top portion for engaging the cross beam and a bottom portion for resting on the ground; (b) a rotatable member having means for connecting the rotatable member to the cross beam, a portion of the rotatable member including external threads; (c) a recess formed in the top portion of the frame for receiving a portion of the rotatable member; and (d) a nut mounted on the frame for engaging the externally threaded portion of the rotatable member and connecting the rotatable member to the frame, rotation of the nut causing the rotatable member to be raised or lowered.

Also according to the present invention, there is provided a sawhorse, comprising: (a) a cross beam; and (b) at least two bases for supporting the cross beam above the ground, each of the bases including: (A) a substantially triangular frame having a top portion for engaging the cross beam and a bottom portion for resting on the ground; (B) a rotatable member having means for connecting the rotatable member to the cross beam, a portion of the rotatable member including external threads; (C) a recess formed in the top portion of the frame for receiving a portion of the rotatable member; and (D) a nut mounted on the frame for engaging the externally threaded portion of the rotatable member and connecting the rotatable member to the frame, rotation of the nut causing the rotatable member to be raised or lowered.

According to further features in preferred embodiments of the invention described below, the rotatable member includes at least one rotatable member orifice and wherein the frame surrounding the recess includes at least one frame orifice which is complementary to the rotatable member orifice such that the rotatable member and frame orifices are aligned when the rotatable member is rotated to a specific orientation relative to the recess, preferably when the rotatable member is in a position such that the cross beam is substantially perpendicular to a plane formed by the frame.

According to still further features in the described preferred embodiments the sawhorse further includes a set peg for insertion into the rotatable member and frame orifices when they are aligned, thereby immobilizing the rotatable member with respect to the frame.

According to another embodiment, the sawhorse is further provided with a bracket detachably mounted on the cross beam for accommodating cylindrical work pieces.

The present invention successfully addresses the shortcomings of the presently known configurations by making it possible to readily and easily significantly reduce the bulk of a sawhorse for purposes of storage without significantly adding to the cost of the sawhorse and without needlessly complicating its use.

The present invention discloses a novel sawhorse system wherein each of the two or more bases includes a rotatable member which is nested in the sawhorse base frame. The rotatable member can be alternately drawn into close contact with the frame or retracted somewhat by simply turning a nut which connects the rotatable member to the frame. When the rotatable member and frame are drawn together they effectively form a firm body which can support various work pieces during normal operations. When the two are retracted slightly from each other, rotatable body becomes rotatable relative to the frame which makes it possible to rotate the frame of the base relative to the cross beam so as put the frame and cross beam in the same plane, thereby significantly reducing the bulk of the sawhorse and greatly facilitating storage of the sawhorse between uses.

BRIEF DESCRIPTION OF THE DRAWINGS

The invention is herein described, by way of example only, with reference to the accompanying drawings, wherein:

FIG. 6 is a perspective view of a sawhorse as in FIG. 1 but further including a pair of support bracket installed on the sawhorse beam;

FIG. 7 is a plan view of a support bracket of FIG. 6 including a locking mechanism;

FIG. 8 is a bottom view of the locking mechanism of FIG. 7.

DESCRIPTION OF THE PREFERRED EMBODIMENTS

Figure 1:
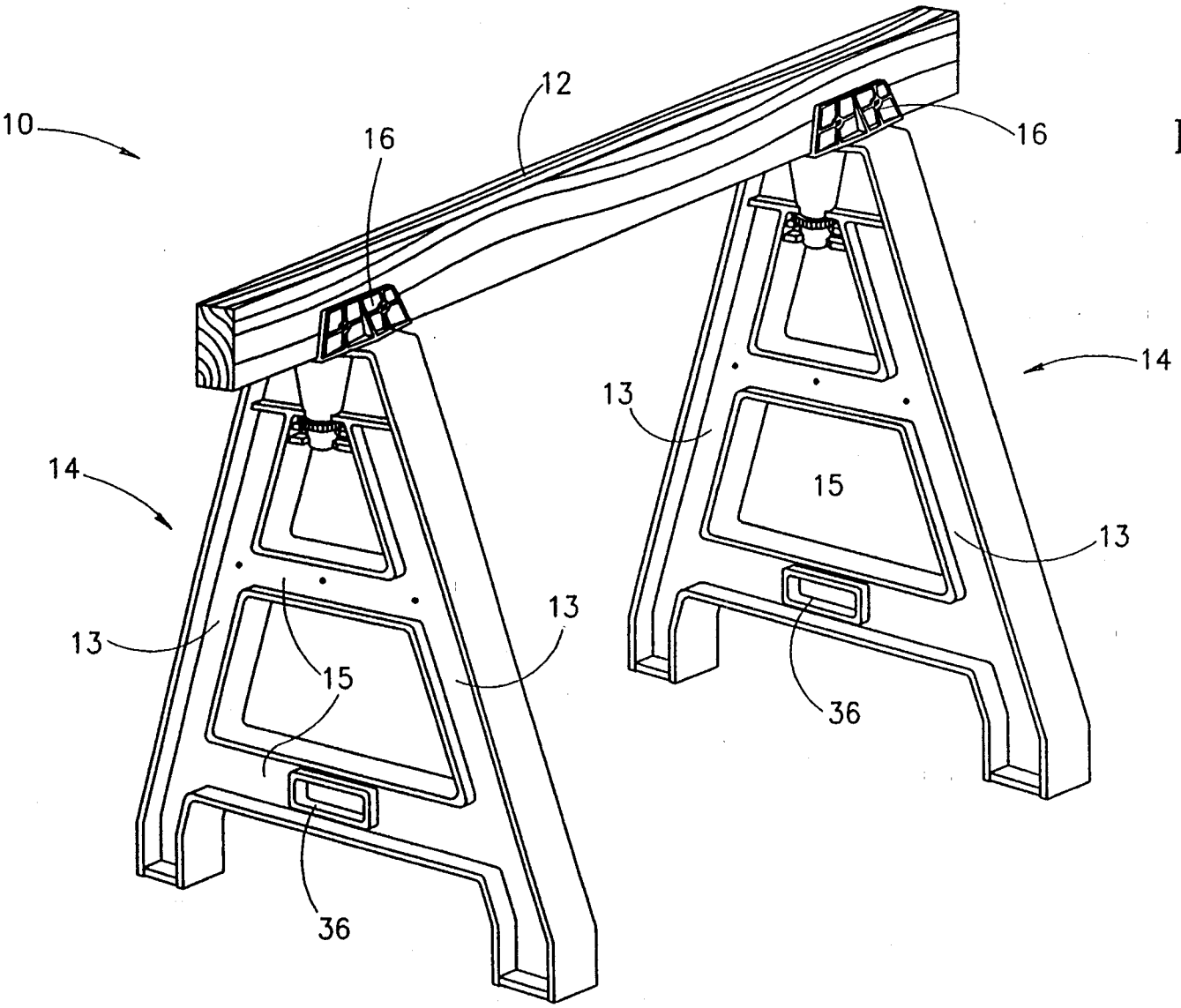
FIG. 1 is a perspective view of a sawhorse using a pair of bases according to the present invention in the deployed position.

The present invention is of a sawhorse, and more specifically of sawhorse bases which can be alternately rotated between a working configuration and a storage configuration.

The principles and operation of a sawhorse according to the present invention may be better understood with reference to the drawings and the accompanying description.

Referring now to the drawings, FIG. 1–8 illustrate various aspects of sawhorses using bases according to the present invention. Sawhorse 10 is typically made up of a cross beam 12 and two or more bases 14. Cross beam 12 may be made of any suitable material and is preferably a wooden beam of appropriate dimensions which will depend on the intended use of sawhorse 10.

Each of bases 14 includes a substantially triangular frame having a top portion for engaging cross beam 12 and a bottom portion for resting on a solid surface, such as the ground, the floor, and the like (hereinafter referred to as "ground"). Preferably, the frame includes a pair of diverging legs 13 and at least one substantially horizontal bracing member 15 (two are shown in the Figures) connecting diverging legs 13.

Figure 2:
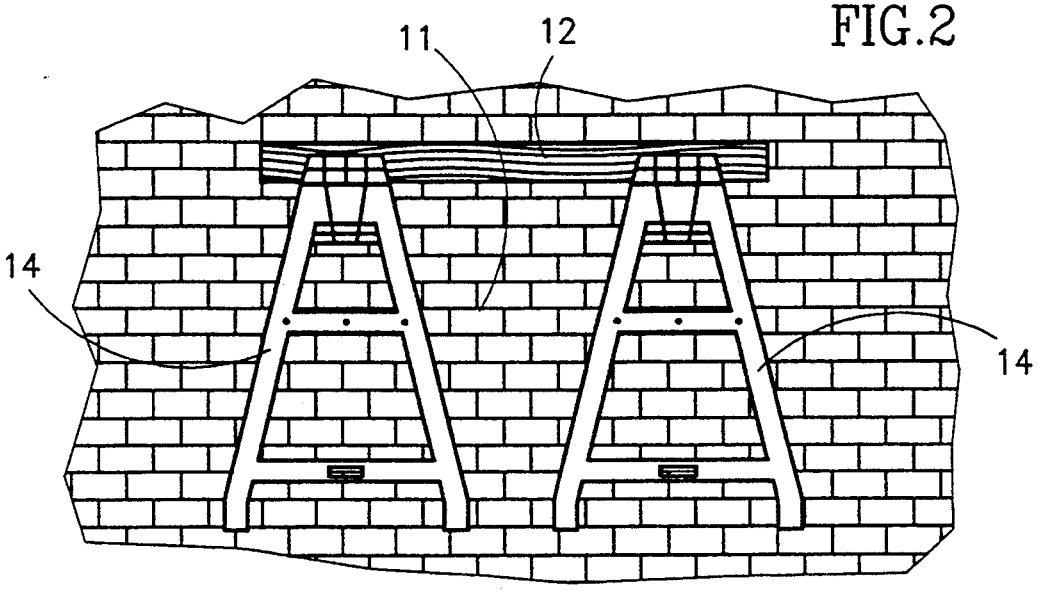
FIG. 2 shows a sawhorse as in FIG. 1 as it would appear when stored, as by hanging on a wall.

At or near the top portion of base 14 is a rotatable member 16 which includes means for connection of rotatable member 16 to cross beam 12, which connection can be effected with the help of various nails, screws, clamps other fasteners, adhesives and the like. The ability of rotatable member 16 to rotate relative to the rest of base 14 makes it possible to rotate base 14 relative to cross beam 12 so as to put bases 14 and cross beam 12 in substantially the same plane so as to greatly reduce the bulk of sawhorse 10 and dramatically facilitate its storage as, for example, by hanging on a wall 11 (FIG. 2).

Preferably, rotatable member 16 includes an upper section which is a U-shaped channel (FIG. 3), the channel being formed of a horizontal base portion 18 and a pair of opposing vertical sidewalls 20 which together form a space which is suitable for accommodating the cross beam therebetween (FIG. 1). Preferably, each of sidewalls 20 of the U-channel include at least one opening 22 (FIG. 3) for accommodating a fastener, such as a nail or screw, and the like, which can readily permanently connect sidewalls 20 and cross beam 12.

Rotatable member 16 is dimensioned so that at least a portion of rotatable member 16 fits within a recess formed in the top portion of the frame of base 14. The recess, which is preferably defined by a housing 23 thus receives a portion of rotatable member 16. Preferably, the recess and the portion of rotatable member 16 accommodated with the recess are both substantially conically shaped.

Rotatable member 16 includes an externally threaded portion 24 (FIG. 5) over at least a portion of its outside surface. Preferably, the portion of rotatable member 16 which is externally threaded 24 is at or near the lower end of rotatable member 16 and extends beyond the bottom end of housing 23 which defines the recess which accommodates rotatable member 16.

Figure 3:
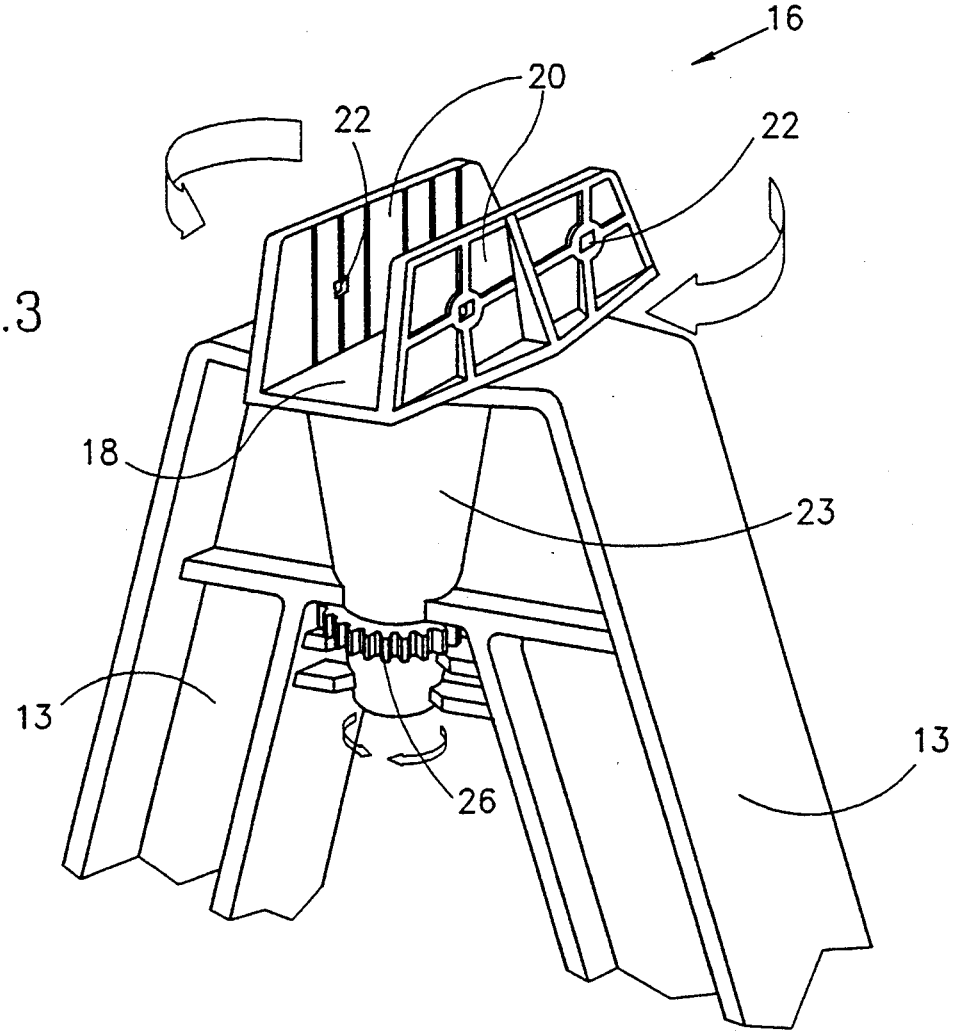
FIG. 3 is a close-up view of the top portion of a sawhorse base according to the present invention.
Figure 4:
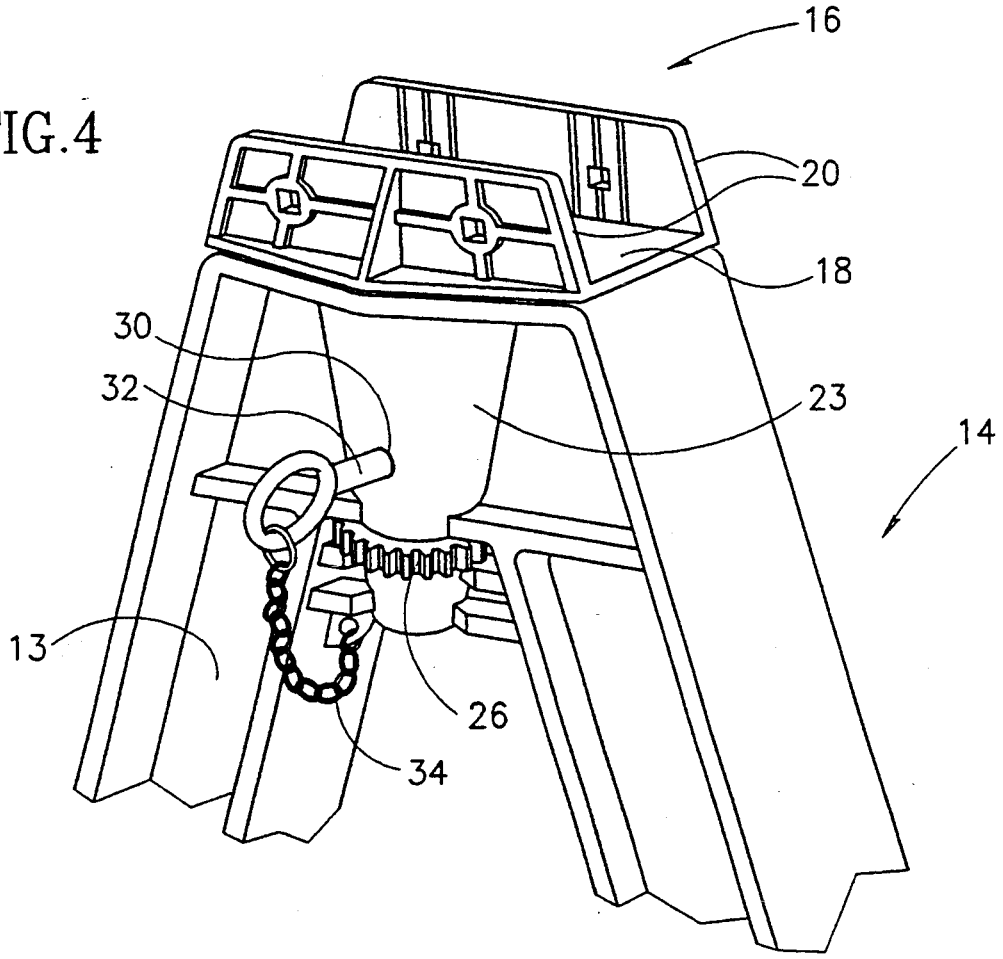
FIG. 4 shows a preferred embodiment including a set pin.
Figure 5:
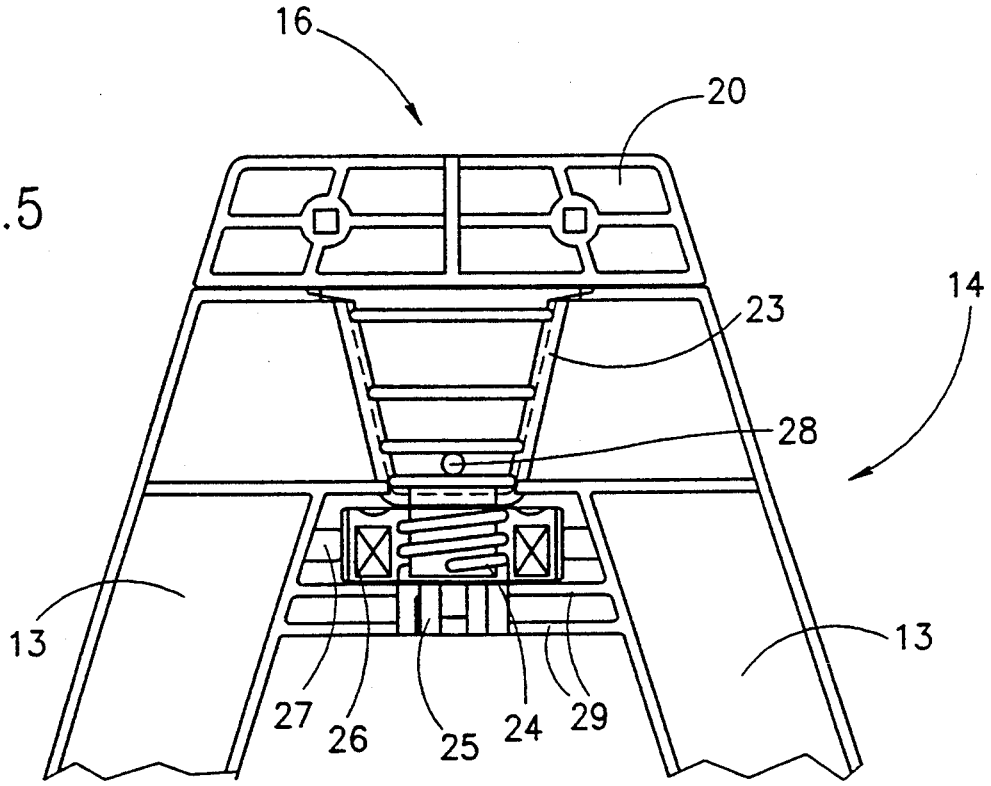
FIG. 5 shows the internal structure of the rotatable top portion of a base according to the present invention.

Base 14 further includes a nut 26 which is mounted on the frame and whose function it is to engage externally threaded portion 24 of rotatable member 16 and to connect rotatable member 16 to the frame of base 14. As can be seen in FIGS. 3 and 5, rotation of nut 26 in one sense causes rotatable member 16 to be raised slightly relative to the frame of base 14 while rotation of nut 26 in the other sense urges rotatable member 16 and the frame of base 14 together. Threaded portion 24 of rotatable member 16 and nut 26 are arranged such that when it is desired to use sawhorse 10, rotation of nut 26 in the appropriate sense will press rotatable member 16 and the frame of base 14 together firmly with cross beam 12 substantially perpendicular to the plane formed by the frame of base 14. The firm contact over a relatively large surfaces between rotatable member 16 and the frame of base 14 ensures that friction forces will not allow the two to rotate relative to each other in the course of operations without the direct intervention of the user.

Following operations, when it is desired to rotate bases 14 for storage, the user rotates nut 26 in the opposite sense, causing rotatable member 16 and the frame of base 14 to separate slightly and allowing the user to rotate bases 14 approximately 90° so that bases 14 and cross beam 12 all lie in substantially the same plane.

Preferably, nut 26 includes protrusions on its outside surface which are dimensioned so that during rotation of nut 26 the protrusions impact a stationary portion 27 of the frame of base 14 to produce an audible clicking sound which gives the user an indication that nut 26 is being turned and which incidentally serves to some extent to prevent the spontaneous rotation of nut 26 in the absence of the application of force by the user.

Preferably, the bottommost portion 25 of rotatable member 16 is also externally threaded so that during rotation of rotatable member 16 the external threads impact a second stationary portion 29 of the frame of base 14 to produce an audible clicking sound which gives the user an indication that rotatable member 16 is being turned and, more importantly, which serves to prevent the spontaneous rotation of rotatable member 16 in the absence of the application of force by the user.

To further secure rotatable member 16 and the frame of base 14 together during use of sawhorse 10, rotatable member 16 preferably further includes at least one orifice 28 and housing 23 defining the recess in which rotatable member 16 is accommodated also at least one orifice 30. Orifices 28 and 30 are complementary such that they are aligned whenever rotatable member 16 is rotated to a specific orientation relative to the recess.

Preferably, orifice 28 extends through rotatable member 16 or is defined by a pair of opposing orifices in rotatable member 16. Similarly, orifices 30 is preferably defined by a pair of opposing orifices in housing 23 defining the recess in which rotatable member 16 is accommodated.

Orifices 28 and 30 are located such that they are aligned when rotatable member 16 is in a position such that cross beam 12 is substantially perpendicular to a plane formed by the frames of bases 14, i.e., when sawhorse 10 is in the working extended configuration. Optionally, additional orifices (not shown) may be provided which are located such that they are aligned when rotatable member 16 is in a position such that cross beam 12 is substantially in the plane formed by the frames of bases 14, i.e., when sawhorse 10 is in the compact storage configuration.

The alignment of orifices 28 and 30 in the working configuration makes it possible to insert a set peg 32 (FIG. 4) through orifices 28 and 30 when they are aligned so as to further secure and stabilize sawhorse 10 for operations.

Preferably, set peg 32 is permanently attached to the frame of base 14, using a chain 34 or similar attachments means, so as to eliminate the possibility of its being lost or misplaced and to guarantee its immediately availability.

Preferably, sawhorse base 14 according to the present invention further includes an opening 36 (FIG. 1), preferably formed in one of horizontal bracing members 15, which is dimensioned to accommodate a second cross beam (not shown) for the purpose of further strengthening sawhorse 10.

Preferably, a sawhorse system according to the present invention further includes a bracket 38 (FIGS. 6 and 7), two or more of which are detachably mounted on cross beam 12. The upper portion of bracket 38 includes a V-shaped groove 40 for accommodating various cylindrical work pieces (not shown). The lower portion of bracket 38 includes a U-channel 42 which is dimensioned to fit over cross beam 12. An optional locking device 44 (FIGS. 7 and 8) of suitable design is useful for detachably connection bracket 38 to cross beam 12.

While the invention has been described with respect to a limited number of embodiments, it will be appreciated that many variations, modifications and other applications of the invention may be made.

What is claimed is:

1. A sawhorse base for supporting a sawhorse cross beam above the ground, comprising:

(a) a substantially triangular frame having a top portion for engaging the cross beam and a bottom portion for resting on the ground;

(b) a rotatable member having means for connecting said rotatable member to the cross beam, a portion of said rotatable member including external threads;

(c) a recess formed in said top portion of said frame for receiving a portion of said rotatable member; and (d) a nut mounted on said frame for engaging said externally threaded portion of said rotatable member and connecting said rotatable member to said frame, rotation of said nut causing said rotatable member to be raised or lowered.

2. A sawhorse base as in claim 1, wherein said recess is conical.

3. A sawhorse base as in claim 1, wherein said means for connection between said rotatable member and the cross beam includes a U-shaped channel having a base portion and a pair of opposing sidewalls for accommodating the cross beam therebetween.

4. A sawhorse base as in claim 3, wherein each of said sidewalls of said U-channel include at least one openings for accommodating a fastener.

5. A sawhorse base as in claim 1, wherein said frame further includes an opening at or near said bottom portion for accommodating a second cross member.

6. A sawhorse base as in claim 1, wherein said frame includes a pair of diverging legs and at least one substantially horizontal bracing member connecting said diverging legs.

7. A sawhorse base as in claim 1, wherein said nut includes protrusions on its outside surface, said protrusions such that during rotation of said nut said protrusions impact a portion of said frame to produce a clicking sound.

8. A sawhorse base as in claim 1, wherein said rotatable member includes at least one rotatable member orifice and wherein said frame surrounding said recess includes at least one frame orifice which is complementary to said rotatable member orifice such that said rotatable member and frame orifices are aligned when said rotatable member is rotated to a specific orientation relative to said recess.

9. A sawhorse base as in claim 1, wherein said rotatable member orifice includes at least one pair of opposing rotatable member orifices and wherein said frame surrounding said recess includes at least one pair of opposing frame orifices which are complementary to said rotatable member orifices such that said pairs of rotatable member and frame orifices are aligned when said rotatable member is rotated to a specific orientation relative to said recess.

10. A sawhorse base as in claim 8, wherein said rotatable member and frame orifices are aligned when said rotatable member is in a position such that the cross beam is substantially perpendicular to a plane formed by said frame.

11. A sawhorse base as in claim 9, wherein said pairs of rotatable member and frame orifices are aligned when said rotatable member is in a position such that the cross beam is substantially perpendicular to a plane formed by said frame.

12. A sawhorse, comprising:

(a) a cross beam; and (b) at least two bases for supporting said cross beam above the ground, each of said bases including:

(A) a substantially triangular frame having a top portion for engaging said cross beam and a bottom portion for resting on the ground;

(B) a rotatable member having means for connecting said rotatable member to said cross beam, a portion of said rotatable member including external threads;

(C) a recess formed in said top portion of said frame for receiving a portion of said rotatable member; and (D) a nut mounted on said frame for engaging said externally threaded portion of said rotatable member and connecting said rotatable member to said frame, rotation of said nut causing said rotatable member to be raised or lowered.

13. A sawhorse as in claim 12, wherein said means for connection between said rotatable member and said cross beam includes a U-shaped channel having a base portion and a pair of opposing sidewalls for accommodating said cross beam therebetween.

14. A sawhorse as in claim 12, wherein said frame includes a pair of diverging legs and at least one substantially horizontal bracing member connecting said diverging legs.

15. A sawhorse as in claim 12, wherein said rotatable member includes at least one rotatable member orifice and wherein said frame surrounding said recess includes at least one frame orifice which is complementary to said rotatable member orifice such that said rotatable member and frame orifices are aligned when said rotatable member is rotated to a specific orientation relative to said recess.

16. A sawhorse as in claim 15, wherein said rotatable member and frame orifices are aligned when said rotatable member is in a position such that the cross beam is substantially perpendicular to a plane formed by said frame.

17. A sawhorse as in claim 12, further comprising a set peg for insertion into said rotatable member and frame orifices when they are aligned.

18. A sawhorse as in claim 17, further comprising means for attaching said set peg to said frame.

19. A sawhorse as in claim 12, further comprising a bracket detachably mounted on said cross beam for accommodating cylindrical work pieces.

20. A sawhorse as in claim 19, wherein said bracket includes a locking mechanism for reversibly locking said bracket onto said cross beam.

* * * * *